US008397787B1

(12) United States Patent
Daus et al.

(10) Patent No.: US 8,397,787 B1
(45) Date of Patent: Mar. 19, 2013

(54) DOOR RELEASE MECHANISM

(75) Inventors: Mark Daus, Doylestown, OH (US); Alvin R. Eiterman, Hilliard, OH (US)

(73) Assignee: Overhead Door Corporation, Lewisville, TX (US)

( * ) Notice: Subject to any disclaimer, the term of this patent is extended or adjusted under 35 U.S.C. 154(b) by 160 days.

(21) Appl. No.: 12/762,667

(22) Filed: Apr. 19, 2010

Related U.S. Application Data

(60) Provisional application No. 61/170,888, filed on Apr. 20, 2009.

(51) Int. Cl.
*E05F 15/20* (2006.01)

(52) U.S. Cl. ..... 160/9; 160/1; 475/254; 475/310

(58) Field of Classification Search ..... 160/1, 7, 160/8, 9, 321; 475/254, 310
See application file for complete search history.

(56) References Cited

U.S. PATENT DOCUMENTS

| | | | | |
|---|---|---|---|---|
| 1,270,964 | A | | 7/1918 | McCloud |
| 1,617,439 | A | | 2/1927 | Duncanson |
| 1,718,752 | A | | 6/1929 | McCloud |
| 2,374,829 | A | | 5/1945 | Nardone |
| 2,564,208 | A | | 8/1951 | Michelman |
| 2,946,377 | A | | 7/1960 | Zoll et al. |
| 3,420,121 | A | | 1/1969 | Stieg |
| 3,685,567 | A | | 8/1972 | Pemberton et al. |
| 3,752,208 | A | | 8/1973 | Roberts |
| 4,147,197 | A | | 4/1979 | Bailey et al. |
| 4,664,170 | A | | 5/1987 | Labelle |
| 5,022,452 | A | | 6/1991 | Burrell |
| 5,123,134 | A | | 6/1992 | Alberto |
| 5,203,392 | A | | 4/1993 | Shea |
| 5,245,879 | A | * | 9/1993 | McKeon ..... 74/2 |
| 5,253,693 | A | | 10/1993 | Marlatt et al. |
| 5,261,186 | A | | 11/1993 | Saino |
| 5,263,527 | A | | 11/1993 | Marlatt et al. |
| 5,353,859 | A | | 10/1994 | Oltahfer et al. |
| 5,355,927 | A | * | 10/1994 | McKeon ..... 160/7 |
| 5,482,103 | A | | 1/1996 | Burgess et al. |
| 5,542,460 | A | * | 8/1996 | McKeon ..... 160/7 |
| 5,576,581 | A | | 11/1996 | Iannuzzi et al. |
| 5,613,321 | A | | 3/1997 | Rizkovsky |
| 5,839,766 | A | | 11/1998 | Iannuzzi et al. |
| 5,893,234 | A | * | 4/1999 | McKeon ..... 49/30 |
| 5,896,907 | A | | 4/1999 | Dever et al. |
| 5,931,212 | A | | 8/1999 | Mullet et al. |

(Continued)

OTHER PUBLICATIONS

Protest filed with the U.S. Patent & Trademark Office on Aug. 6, 2009 in U.S. Appl. No. 11/976,363.

(Continued)

*Primary Examiner* — Blair M Johnson
*Assistant Examiner* — Jaime F Cardenas-Garcia
(74) *Attorney, Agent, or Firm* — Gardere Wynne Sewell LLP

(57) ABSTRACT

A door mechanism includes a bracket and a door shaft, rotationally mounted to the bracket, to operate a door. The door mechanism includes a gear assembly having a ring gear, set of planetary gears, sun gear, and drive sprocket. The ring gear fixed to the door shaft. The door mechanism includes a holding brake to counter the closing bias of the door. The door release has an engaged position in which rotation of the door shaft in the second direction is impeded by a first brake; and a disengaged position in which rotation of the door shaft in the second direction is unimpeded by the first brake. The door mechanism includes a link and a second brake. The link is configured to melt in response to a predetermined temperature. The second brake is configured to provide resistance in response to component rotation exceeding a predetermined speed.

6 Claims, 15 Drawing Sheets

U.S. PATENT DOCUMENTS

| | | | | |
|---|---|---|---|---|
| 6,014,307 | A | 1/2000 | Crimmins | |
| 6,055,885 | A | 5/2000 | Shea | |
| 6,123,134 | A | 9/2000 | Thomas et al. | |
| 6,155,234 | A | 12/2000 | Hartke et al. | |
| 6,196,943 | B1 | 3/2001 | Chen | |
| 6,338,412 | B1 | 1/2002 | Serres et al. | |
| 6,388,412 | B1 | 5/2002 | Reed et al. | |
| 6,401,792 | B1 | 6/2002 | Mullet et al. | |
| 6,422,965 | B1 | 7/2002 | Balli et al. | |
| 6,484,784 | B1 | 11/2002 | Weik, III et al. | |
| 6,530,863 | B2 | 3/2003 | Balli et al. | |
| 6,712,116 | B2 * | 3/2004 | Beaudoin et al. | 160/188 |
| 6,737,823 | B2 | 5/2004 | Reed et al. | |
| 6,890,279 | B2 * | 5/2005 | Ryberg | 475/149 |
| 6,959,751 | B2 | 11/2005 | Savard et al. | |
| 6,986,378 | B2 | 1/2006 | Beaudoin et al. | |
| 7,055,283 | B2 * | 6/2006 | Hsieh | 49/139 |
| 7,086,441 | B2 | 8/2006 | Barriault et al. | |
| 7,878,230 | B2 * | 2/2011 | Daus et al. | 160/9 |
| 2002/0111242 | A1 | 8/2002 | Balli et al. | |
| 2009/0108245 | A1 * | 4/2009 | Daus et al. | 254/354 |
| 2011/0099914 | A1 * | 5/2011 | Herrin | 49/506 |

OTHER PUBLICATIONS

Written Opinion issued on Apr. 27, 2010 in corresponding PCT Application No. PCT/US2008/080683.

International Search Report and Written Opinion issued on Dec. 18, 2008.

* cited by examiner

DOOR RELEASE MECHANISM

CLAIM OF PRIORITY

This application claims the benefit of, U.S. Provisional Patent Application Ser. No. 61/170,888 filed Apr. 20, 2009, entitled DOOR RELEASE MECHANISM, the disclosure of which is incorporated herein by reference in its entirety.

FIELD OF THE INVENTION

The present invention generally relates to a door mechanism. More particularly, the present invention pertains to a device and system for automatically releasing a door in response to an event.

BACKGROUND OF THE INVENTION

Conventionally, door hoist systems are utilized to operate a variety of doors. Particular examples of doors operated via a door hoist include rolling type, sectional, and the like. These types of doors are typically utilized for controlling access to garages, ware houses, etc. In the event of a fire, it is generally beneficial to close these doors to limit the amount of oxygen supplied to the fire and slow the spread of fire from one side of the door to the other.

Conventional electronic fire door systems are generally electronically or computer operated. Such systems are costly to design, install, and maintain. In addition, conventional electronic fire door systems are generally significantly larger than a standard door hoist. As such, retrofitting electronic fire door systems into an existing building may require structural alteration of the building. As a result, the installation and maintenance of electronic fire door systems may be cost prohibitive in some instances.

Accordingly, it is desirable to provide a method and apparatus capable of overcoming the disadvantages described herein at least to some extent.

SUMMARY OF THE INVENTION

The foregoing disadvantages are overcome, at least to a great extent, by the present invention, wherein in one respect, a device and system is provided that in some embodiments automatically releases a door in response to an event.

An embodiment of the present invention pertains to a door mechanism. The door mechanism includes a bracket and a door shaft to operate a door. The door shaft is rotationally mounted to the bracket. The door shaft rotates in a first direction in response to the door being raised. The door shaft rotates in a second direction in response to door being lowered and the door is biased to close. The door mechanism includes a gear assembly having a ring gear, set of planetary gears, sun gear, and drive sprocket. The ring gear fixed to the door shaft. The set of planetary gears is mated to the ring gear and a set of respective axes of the set of planetary gears being fixed relative to the bracket. The sun gear is mated to the set of planetary gears and the drive sprocket is fixed to the sun gear. The door mechanism includes a holding brake to counter the closing bias of the door. The holding brake includes a holding brake sprocket, freewheel, and first brake. The holding brake sprocket is rotationally coupled to the drive sprocket. The freewheel is coupled to the holding brake sprocket to facilitate free rotation of the door shaft in the first direction. The first brake is coupled to the holding brake sprocket via the freewheel to provide resistance to rotation of the door shaft in the second direction. The door release has an engaged position and a disengaged position. In response to the door release being in the engaged position, rotation of the door shaft in the second direction is impeded by the first brake. In response to the door release being in the disengaged position, rotation of the door shaft in the second direction is unimpeded by the first brake. The door mechanism includes a link and a second brake. The link is to secure the door release in the engaged position and is configured to melt in response to an ambient temperature exceeding a predetermined temperature. The second brake has a brake sprocket rotationally coupled to the drive sprocket. The second brake is configured to provide resistance to the brake sprocket in response to rotation of the brake sprocket exceeding a predetermined braking speed.

Another embodiment of the present invention relates to a door mechanism. The door mechanism includes a bracket and a door shaft to operate a door. The door shaft is rotationally mounted to the bracket. The door being raised in response to the door shaft rotating in a first direction. The door being lowered in response to the door shaft rotating in a second direction and the door being biased to close. The door mechanism includes a gear assembly having a first gear, second gear, and drive sprocket. The first gear is fixed to the door shaft. The second gear is mated to the first gear and the second gear is fixed to an operating shaft configured to receive a crank-arm. The drive sprocket is fixed to the door shaft. The door mechanism includes a holding brake to counter the closing bias of the door which includes a holding brake sprocket, freewheel, and first brake. The holding brake sprocket is rotationally coupled to the drive sprocket. The freewheel is coupled to the holding brake sprocket and the freewheel is configured to provide free rotation of the holding brake sprocket in the first direction. The first brake is coupled to the holding brake sprocket via the freewheel. The door mechanism includes a door release having a release cog, brake drive sprocket, and drop arm. The release cog is coupled to the holding brake sprocket via the first brake. The brake drive sprocket is fixed the release cog and the drop arm has a tooth to mesh with the release cog. The drop arm has an engaged position and a disengaged position. In response to the drop arm being in the engaged position, rotation of the brake drive sprocket is prevented. In response to the drop arm being in the disengaged position, rotation of the holding brake sprocket in the second direction urges the brake drive sprocket to rotate. The door mechanism includes a link and second brake. The link is to secure the drop arm in the engaged position and is configured to melt in response to an ambient temperature exceeding a predetermined temperature. The second brake has a brake sprocket rotationally coupled to the brake drive sprocket. The second brake is configured to provide resistance to rotation of the brake sprocket in response to rotation of the brake sprocket exceed a predetermined braking speed.

Yet another embodiment of the present invention pertains to a door mechanism. The door mechanism includes a bracket and a door shaft to operate a door. The door shaft is rotationally mounted to the bracket. The door shaft rotates in a first direction in response to the door being raised. The door shaft rotates in a second direction in response to door being lowered and the door is biased to close. The door mechanism include a drive sprocket fixed to the door shaft and attached to a holding brake assembly to counter the closing bias of the door. The holding brake assembly includes a holding brake sprocket, freewheel, and first brake. The holding brake sprocket is rotationally coupled to the drive sprocket. The freewheel is coupled to the holding brake sprocket and configured to provide free rotation of the holding brake sprocket in the first direction. The first brake is coupled to the holding brake sprocket via the freewheel. The first brake provides resistance to rotation of the holding brake sprocket in the second direction. The door mechanism includes a door release having a release cog, brake drive sprocket, and drop arm. The release cog is coupled to the holding brake sprocket via the first brake. The brake drive sprocket is fixed the release cog. The drop arm has a tooth to mesh with the release cog. The drop arm has an engaged position and a disengaged position. In response to the drop arm being in the engaged position, rotation of the brake drive sprocket is prevented. In response to the drop arm being in the disengaged position, rotation of the brake drive sprocket is unimpeded by the release cog. The door mechanism includes a link and a second brake. The link is to secure the drop arm in the engaged position. The link is configured to melt in response to an ambient temperature exceeding a predetermined temperature. The second brake has a brake sprocket rotationally coupled to the brake drive sprocket. The second brake is configured to provide resistance to rotation of the brake sprocket in response to rotation of the brake sprocket exceed a predetermined braking speed.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 11 is an exploded view of a door mechanism according to

FIG. 9.

DETAILED DESCRIPTION OF THE PREFERRED EMBODIMENT

In various embodiments of the invention a simplified device and system are provided to automatically release a door in response to an event. In a particular example, the device is configured to close a door in the event of a fire. For example, when attached to a door that is biased to close, a release assembly connecting a hoist assembly to the door assembly may be configured to release the door assembly from the hoist assembly in response to a fire or smoke. Released from the hoist assembly, the door may be allowed to close. In another example, the release assembly may be configured to release the door assembly from the hoist assembly in response to a security incident. In yet another example, the release assembly connects the hoist assembly to a door assembly that is biased to open. In this example, the release may be controlled to release the door assembly from the hoist assembly to facilitate egress through the door. In comparison to electronically controlled or computer controlled door closing systems, this simplified device is easier, less expensive, and less time consuming to manufacture. For the consumer, this simplified device is easier and less expensive to install and maintain in comparison to electronically controlled door closing systems.

Figure 1:
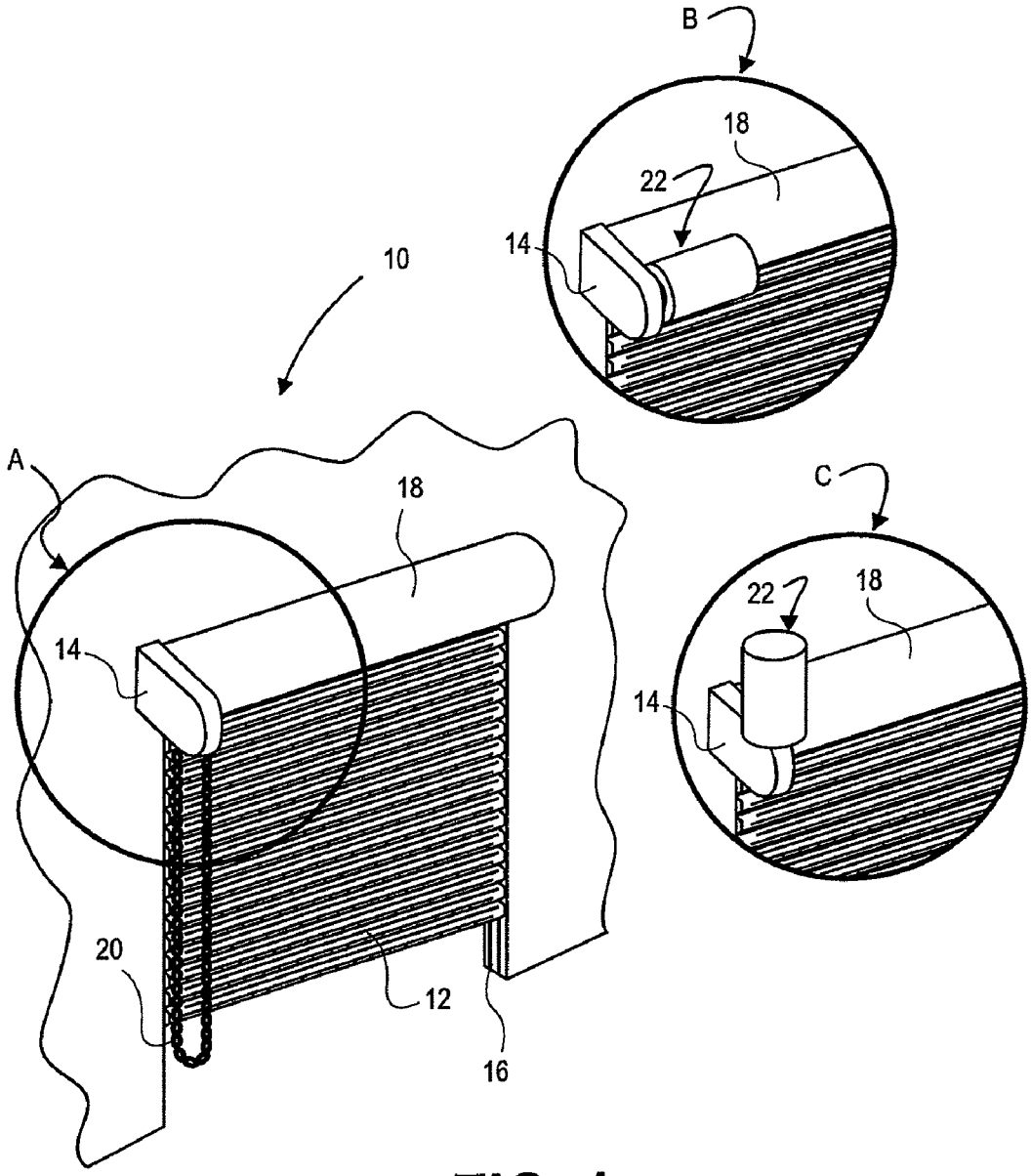
FIG. 1 is a perspective view of a door system according to an embodiment of the invention.

An embodiment of the invention will now be described with reference to the drawing figures, in which like reference numerals refer to like parts throughout. As shown in FIG. 1, a door system 10 includes a door 12 and a hoist 14. The door 12 may include any suitable door or other such covering structure operable to cover an opening. In general, the door 12 may include rollup, swing, sliding, etc. type doors. In a particular example, the door 12 is a conventional rollup type door configured to slide within a track 16 and roll up into a cover 18. Such rollup type doors are well known to include a cylinder or shaft within the cover 18 to operate the door 12. That is, the door 12 is drawn into the cover 18 by rotating the shaft and rolling the door about the shaft or a cylinder connected to the shaft. The door 12 is controlled or allowed to close by rotating the shaft in the opposite direction and/or allowing gravity to draw the door 12 downwards. In this regard, the door 12 is biased in the closed position. A door that is otherwise suitable for use with various embodiments of the invention but is not biased in the closed position may be modified to be biased in the closed position. For example, a spring or weight or other such door closing device may be added to the door.

Figure 2:
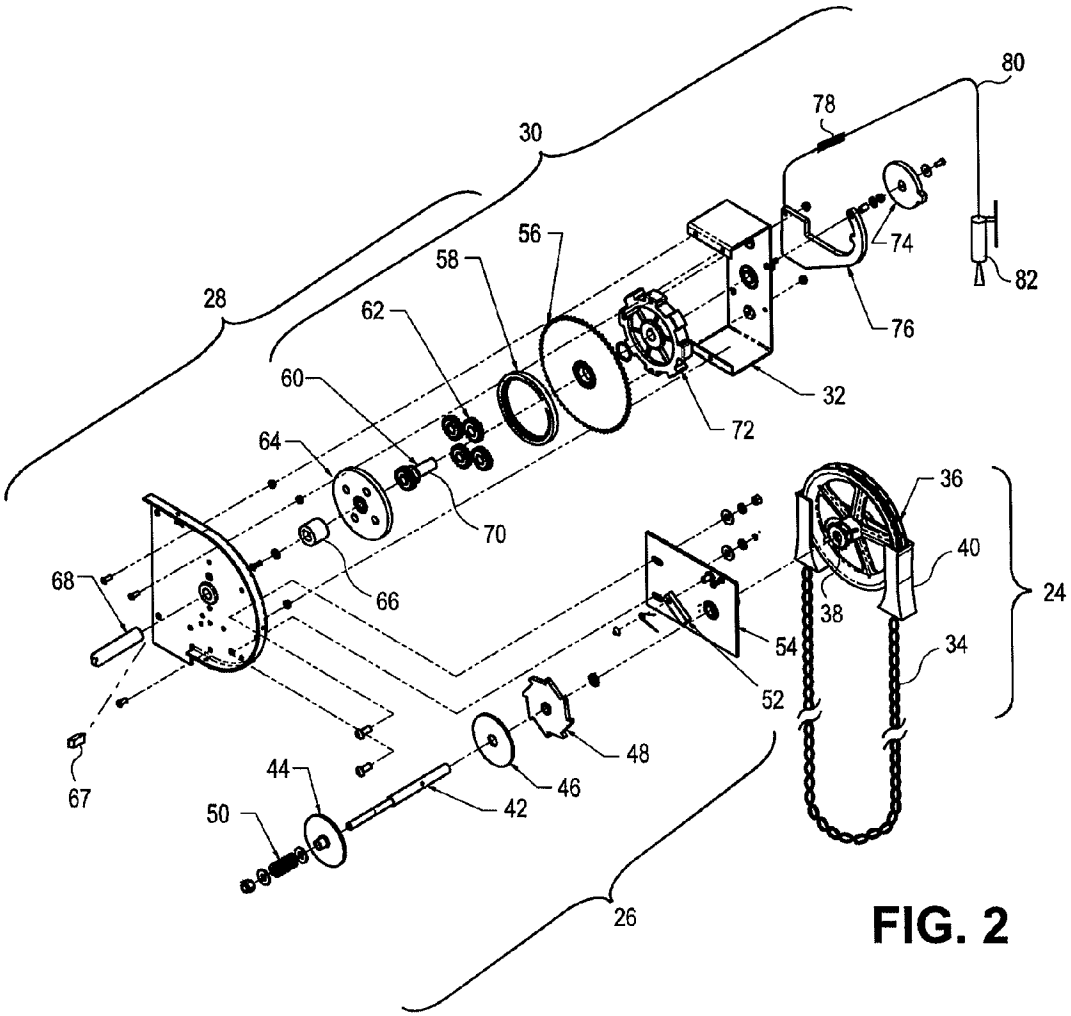
FIG. 2 is an exploded view of the hoist according to an embodiment of the invention.

The hoist 14 according to various embodiments may be operated via any suitable mechanism. In several particular examples shown in insets A, B, and C, the hoist 14 may include a chain drive 20 or motor 22 and the motor 22 may be mounted vertically or horizontally. A particular example of the chain drive 20 is shown in FIG. 2. Particular examples of vertically and horizontally mounted motors 22 are shown respectively shown in FIGS. 5 and 6.

FIG. 2 is an exploded view of the hoist 14 according to an embodiment of the invention. As shown in FIG. 2, the hoist 14 includes a chain hoist wheel assembly 24, holding brake assembly 26, drive assembly 28, door release assembly 30, and bracket 32. The chain hoist wheel assembly 24 is optional and in this and other embodiments, any suitable actuator may be substituted. For example, the motor 22 may replace the chain hoist assembly 24. If present, the chain hoist assembly 24 includes a chain 34, chain hoist wheel 36, chain drive sprocket 38, chain guards 40, and chain hoist shaft 42. To operate the door 12, the chain 34 may be pulled by a user to urge the chain hoist wheel 36 to rotate. The chain drive sprocket 38 is integral to or fastened to the chain hoist wheel 36. As a result, rotation of the chain hoist wheel 36 induces a corresponding rotation of the chain drive sprocket 38. In turn, operation of the chain hoist wheel assembly 24 urges the drive assembly 28 to raise or lower the door 12. As is generally known, inducing a rotation of the drive assembly 28 in a first direction causes the door 12 to raise and inducing an opposite rotation causes the door 12 to lower.

The holding brake assembly 26 is optionally included to accompany actuating assemblies that lack sufficient self-braking characteristics. If present, the holding brake assembly 26 includes a brake pressure plate 44, brake pad 46, ratcheted pressure plate 48, spring 50, pawl 52, and mounting plate 54. The brake pressure plate 44, brake pad 46, ratcheted pressure plate 48, and spring 50 are mounted to the chain hoist shaft 42. The brake pressure plate 44 is pinned or otherwise fixed to rotate with the chain hoist shaft 42. The pawl 52 is mounted to the mounting plate 54 or the bracket 32. The ratcheted pressure plate 48 includes one or more detents or teeth to engage the pawl 52. In this manner, the ratcheted pressure plate 48 is configured to rotate in a first direction and the ratcheted pressure plate 48 is stopped from rotating in a reverse rotational direction by the interaction of the pawl 52 and teeth.

The chain hoist wheel assembly 24 shown in FIG. 2 may provide so little rotational resistance that, barring additional intervention, the door 12 may tend to fall closed. To reduce this tendency, the holding brake assembly 26 is configured to provide resistance to rotation which results in a downward movement of the door 12. To ease the operation of raising the door 12, the holding brake assembly 26 rotates substantially freely in the direction of rotation that raises the door 12.

In other instances, the chain hoist wheel assembly 24, motor 22, or other such actuator may provide sufficient rotational resistance to retain the door 12 in an open position. For example, a worm gear (shown in FIG. 6) may be employed to urge the drive assembly 28 to rotate. The direction of torque transmission (input shaft vs. output shaft) is not reversible in conventional worm gear trains. In this or other such instances, the holding brake assembly 26 may be omitted.

The drive assembly 28 according to various embodiments provides a simplified gear train in comparison to conventional door hoists. This simplified gear train reduces the material and labor costs, reduces the size of the hoist 14, and may increase reliability. It is a further advantage of the drive assembly 28 that the door release assembly 30 is fully integrated into this simplified gear train and shares components therewith. This further simplifies the door system, which results in a further reduction of material and labor costs.

As shown in FIG. 2, the drive assembly 28 includes a drive sprocket 56, annulus or ring gear 58, sun gear 60, set of planetary gears 62, hub assembly 64, and connector 66. The drive sprocket 56 is arranged or configured to mate with the chain drive sprocket 38 or similar such gear of the motor 22 or other such actuator. In an embodiment, the ring gear 58 is integral to or fixed to the drive sprocket 56. In a particular example, the ring gear 58 is welded to the drive sprocket 56 with a central or rotational axis of the ring gear 58 coinciding with a central axis of the drive sprocket 56. The sun gear 60 is disposed to coincide with the central axis of the ring gear 58. The set of planetary gears 62 is disposed between the ring gear 58 and the sun gear 60 and configured to mate with both. While the number of individual planetary gears in the set of planetary gears 62 may vary, such gear trains typically include at least a pair, and more typically four, individual planetary gears to balance and distribute loads throughout the gear train. The hub assembly 64 may serve as a planet carrier for the set of planet gears 62. In this capacity, the ring gear 58 functions as the input shaft, the rotation of which causes the set of planet gears 62 to rotate about a fixed sun gear 60 and the hub assembly 64 is the output shaft to operate the door 12. In this regard, the connector 66 is fixed to the hub assembly 64. The connector 66 is configured to receive and rotationally secure a door shaft 68. The door shaft 68 operates the door 12 and may be secured to the connector 66 in any suitable manner. In a particular example, the door shaft 68 includes a channel for a spline 67, the connector 66 includes a channel for the spline 67, and the door shaft 68 and connector 66 are locked in rotational alignment by the insertion of the spline 67 into the channel. In other examples, the door shaft 68 and connector 66 may include mating "D" or square configurations, and/or may be welded, press fit, or otherwise fastened together.

In another embodiment, the ring gear 58 is integral to or fixed to the hub assembly 64 and the set of planetary gears 62 are rotationally mounted to the sprocket 56. That is, the sprocket 56 may serve as a planet carrier for the set of planet gears 62. In addition, other arrangements of the gear train are within the scope of the invention.

The door release assembly 30 includes a governor shaft 70, governor 72, drop wheel 74, drop arm 76, and link 78. The governor shaft 70 is secured to the sun gear 60. In various examples, the sun gear 60 may be press fit, pinned, splined, or otherwise fixed to the governor shaft 70. The governor 72 includes any suitable governing device such as, for example, a viscous governor, mechanical, brake-type governor, and the like. The governor 72 includes a hub that is fixed to the governor shaft 70. The drop wheel 74 is secured to the governor shaft 70. In various examples, the drop wheel 74 may be press fit, pinned, splined, or otherwise fixed to the governor shaft 70. The drop wheel 74 includes at least one point or tooth configured to engage a corresponding point, indent, or tooth on the drop arm 76. The drop arm 76 includes two ends. A first end is pivotally fixed with respect to the drop wheel 74. The second end is secured via the link 78. In this secured position, the drop arm 76 and the drop wheel 74 are configured to preclude rotation of the governor shaft 70. In response to removal of the link 78 or loss of structural integrity of the link 78, the drop arm 76 is allowed to swing or pivot about the first end and disengage from the drop wheel 74. In this disengaged position, the drop wheel 74 and therefore the governor shaft 70 are free to rotate.

Figure 4:
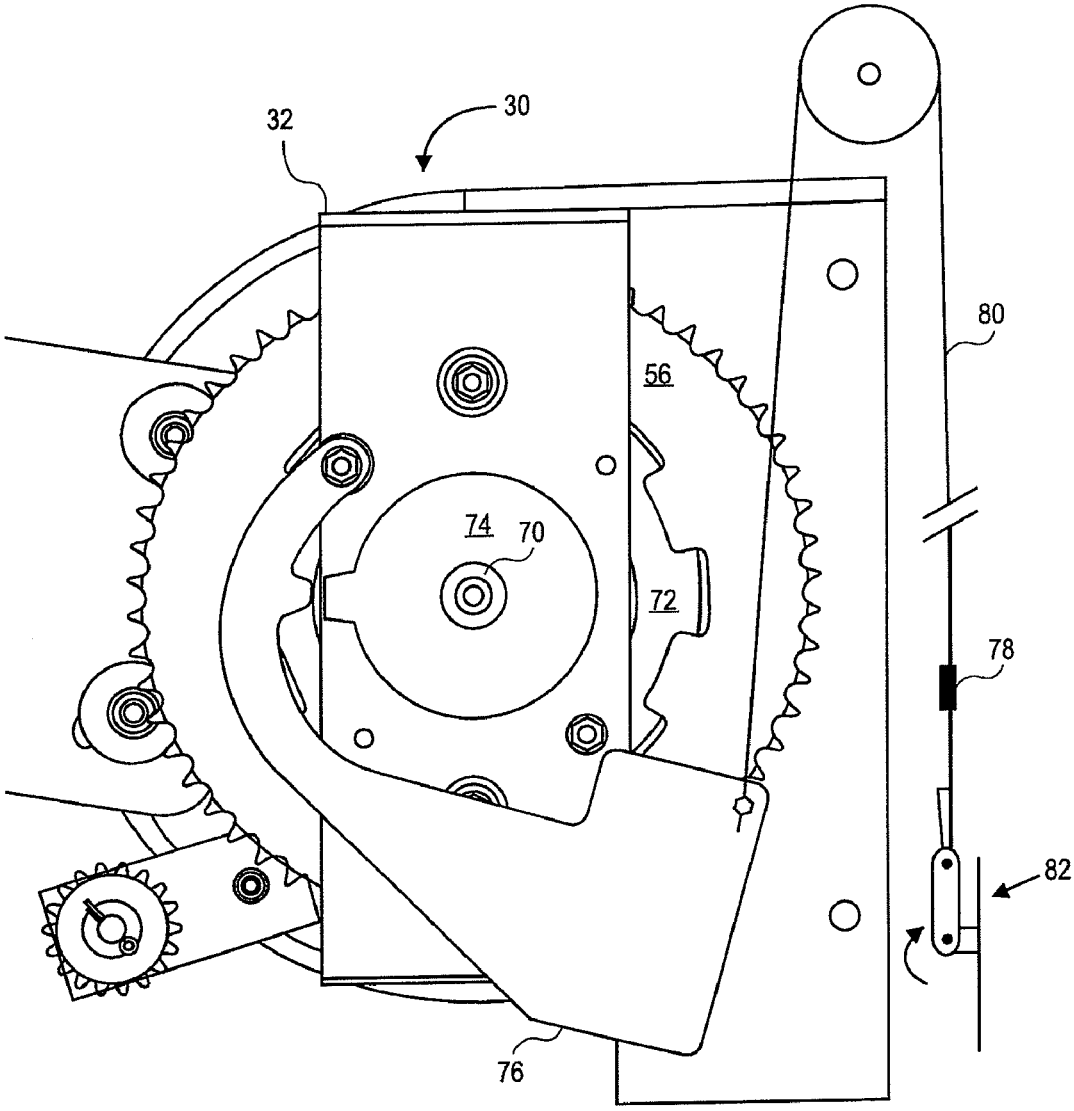
FIG. 4 is a simplified view of the release assembly in a disengaged position according to the embodiment of FIG. 3.
Figure 5:
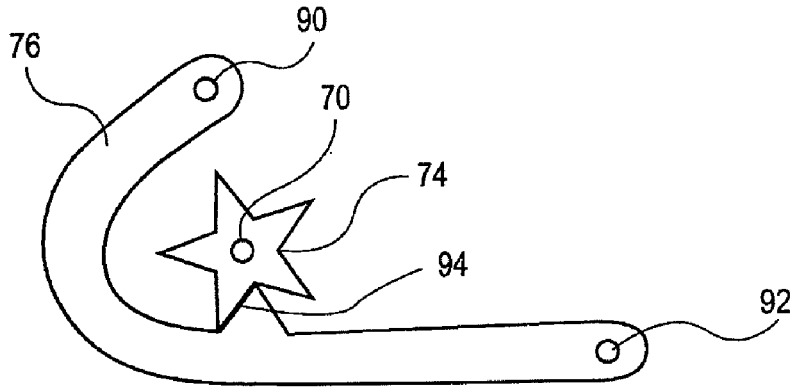
FIG. 5 is a simplified view of a release assembly in an engaged position according to another embodiment of the invention.

According to an embodiment of the invention, at a predetermined temperature, the link 78 is configured to soften, melt, or otherwise lose sufficient structural integrity to retain the drop arm 76. The predetermined temperature may be set according to a variety of factors. These factors may include, for example, expected normal ambient temperature, manufacture's recommendation, empirical data, and the like. To facilitate manual operation and/or testing of the door system 10, the link 78 may be attached to the drop arm 76 via a line 80 and the line 80 may be attached to a handle or switch 82. As shown in FIGS. 4 and 5, the switch 82 may be moved from a first to a second position to control the drop arm 76. In another example, the link 78 may pass through a hole in the bracket 32 to secure the drop arm 76 and a ring or handle may remain outside of a housing. In this manner, the ring provides a gripping surface to remove the link 78 and is readily available to test the door system 10.

According to another embodiment, the link 78 may include an electronic release device such as, for example, an electromagnetically coupled link, solenoid release device, or the like. In this embodiment, the link 78 may release the drop arm 76 in response to any suitable event such as, for example, a smoke alarm activation, security event, manual activation of a switch, and the like.

Figure 3:
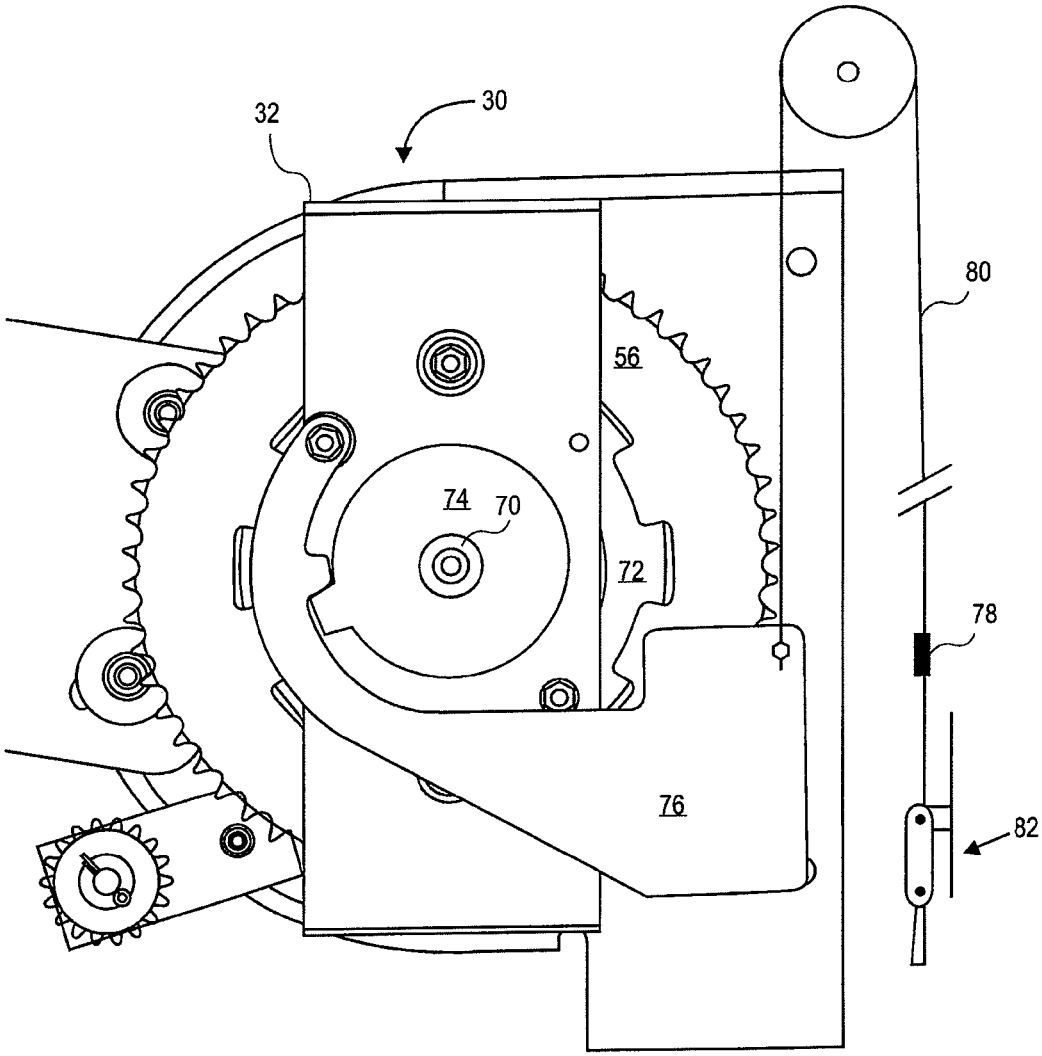
FIG. 3 is a simplified view of a release assembly in an engaged position according to an embodiment of the invention.

FIG. 3 is a simplified view of the drop arm 76 and drop wheel 74 in the engaged position according to FIG. 2. As shown in FIG. 3, the drop arm 76 is secured to the link 78 via the line 80. In addition, the switch 82 is shown in a first configuration. In this first configuration, the line 80 is controlled to retain the drop arm 76 in the engaged position. When secured in the engaged position, the drop arm 76 and drop wheel 74 lock together to prevent the drop wheel 74 from turning. In turn, the governor shaft 70 is prevented from turning by the engaged drop wheel 74. That is, the governor shaft 70 is rotationally fixed relative to the bracket 32 in response to the door release assembly 30 being in the engaged position.

FIG. 4 is a simplified view of the drop arm 76 and drop wheel 74 in the disengaged position according to FIG. 2. As shown in FIG. 4, in response to disposing the switch 82 in a second position or compromising the structural integrity of the link 78, the drop arm 76 is configured to drop from the engaged position. As the drop arm 76 pivots away from the drop wheel 74, the drop wheel 74 is free to rotate. In this manner, the door release assembly may be controlled to release the door 12. Depending upon the bias of the door 12, releasing the release assembly may raise or lower the door 12. In a particular example, the door 12 may be biased to close and the door system 10 is configured to automatically close the door 12 in response to the ambient temperature exceeding the predetermined temperature. It is an advantage of the door system 10 that this automatic closure may proceed in a complete absence of electrical power. It is another advantage of the door system 10 that this automatic closure may proceed even if the chain drive 20 or motor 22 is disabled. It is a further advantage of the door system 10 that the system is easier and less expensive to maintain than an electronically controlled door closing system.

In another example, the link 78 may be electronically controlled to disassemble or otherwise release the line 80. In this example, the link 78 may be controlled to release the line 80 in response to the activation of a smoke alarm or security system activation.

In yet another example, the door 12 may be biased to fully or partially open. For example, in response to the drop arm 76 being released, a closed door 12 may be allowed to fully or partially open. In a particular example, if the door 12 provides an egress for a facility and the door 12 is closed, the door release assembly 30 may be automatically or manually controlled to release to door 12. In this manner, egress through the door 12 may be facilitated.

FIG. 5 is a simplified view of the drop arm 76 and drop wheel 74 in the engaged position. As shown in FIG. 5, the drop arm 76 includes a pivot point 90 and a link point 92. The pivot point 90 may be pivotally connected to the bracket 32 or other such structural member via a shaft, bolt, rivet, or the like. The link point 92 is secured via the link 78 to the bracket 32 or other such structural member of the door system 10. When secured in the engaged position, the drop arm 76 and drop wheel 74 lock together at an engagement interface 84 to prevent the drop wheel 74 from turning. In turn, the governor shaft 70 is prevented from turning by the engaged drop wheel 74. That is, the governor shaft 70 is rotationally fixed relative to the bracket 32 in response to the door release assembly 30 being in the engaged position.

As shown in FIGS. 2, 3, and 4, the link 78 may be secured to the link point 92 via a line 80. In another embodiment, the link 78 may be inserted through the link point 92 and into the bracket 32 or other such structural member. In this embodiment, by altering an angle of the engagement interface 94, the torque being applied to the drop wheel 74, and a length relationship between the pivot point 90, engagement interface 94, and link point 92, an amount of sheer force exerted upon the link 78 may be adjusted. By configuring the structural integrity of the link 78 to fall below the sheer force at the predetermined temperature, the drop arm 76 may be controlled to disengage at the predetermined temperature.

Figure 6:
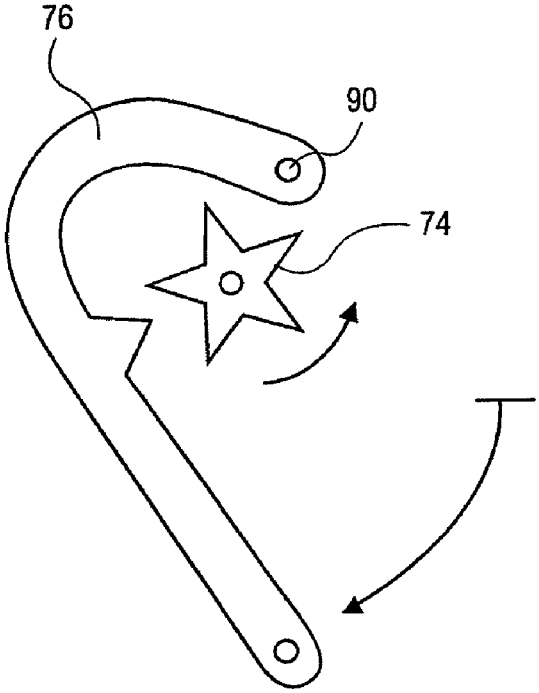
FIG. 6 is a simplified view of the release assembly in a disengaged position according to the embodiment of FIG. 5.

FIG. 6 is a simplified view of the drop arm 76 and drop wheel 74 in the disengaged position according to FIG. 5. As shown in FIG. 6, in response to removal of the link 78 from the link point 92 or the structural integrity of the link 78 failing or falling below the sheer force exerted on the link 78, the drop arm 76 is configured to drop from the engaged position. As the drop arm 76 pivots away from the engagement interface 94 (shown in FIG. 2) the drop wheel 74 is free to rotate.

As shown in FIG. 2, the free rotation of the drop wheel 74 decouples the drive sprocket 56 from the drive assembly 28. That is, the rotational relationship between the drive sprocket 56 and the hub assembly 64 is decoupled. As such, the door 12 is free to close or open in accordance with the bias of the door 12. To control the rate at which the door 12 opens or closes, the rotation of the governor shaft 70 is controlled by the governor 72. In this regard, a hub of the governor 72 is secured to the governor shaft 70 and a housing of the governor 72 is secured to the bracket 32 or suitable structural member. The hub and housing of the governor 72 interact with one another via a viscous fluid or other such braking mechanism. The degree to which the governor 72 slows rotation of the governor shaft 70 may be determined based upon a variety of factors such as, for example, weight or closing bias of the door, fire door closing regulations, empirical data, and the like.

Figure 7:
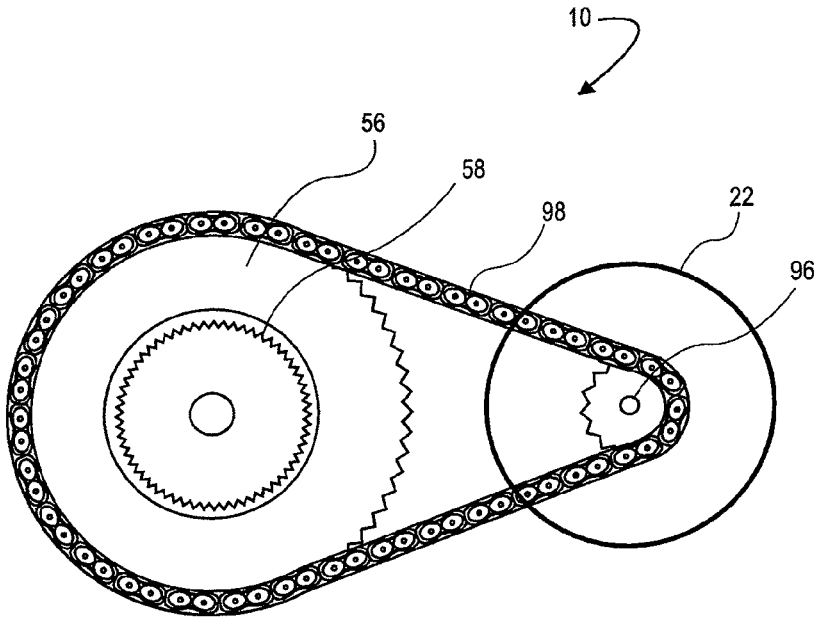
FIG. 7 is a detailed view of a horizontally oriented actuator engaging a drive sprocket according to another embodiment of the invention.

FIG. 7 is a detailed view of a horizontally oriented actuator engaging the drive sprocket 56 according to another embodiment of the invention. As shown in FIG. 7, the door system 10 includes a motor sprocket 96 that is rotated by the motor 22. In various embodiments, the motor sprocket 96 may directly engage the drive sprocket 56 or, as shown in FIG. 7, a chain 98 may engage both the motor sprocket 96 and the drive sprocket 56 and may be configured to transmit rotation of the motor sprocket 96 to the drive sprocket 56.

In another example, the motor sprocket 96 and the drive sprocket 56 may be replaced with pulleys and the chain 98 may be replaced with a belt. These and other such transmission systems are within the purview of various embodiments of the invention.

Figure 8:
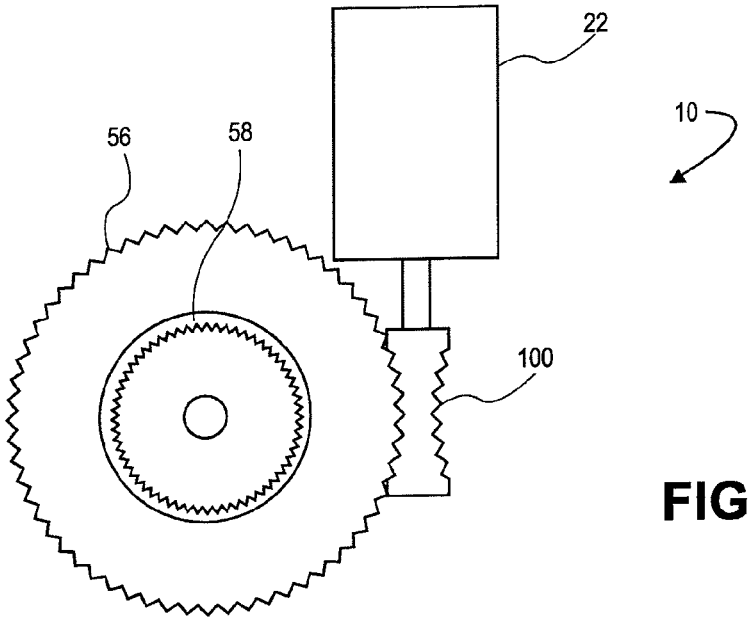
FIG. 8 is a detailed view of a vertically oriented actuator engaging a drive sprocket according to yet another embodiment of the invention.

FIG. 8 is a detailed view of a vertically oriented actuator engaging a drive sprocket 56 according to yet another embodiment of the invention. As shown in FIG. 8, the door system 10 includes a worm gear 100 that is rotated by the action of the motor 22. The worm gear 100 is configured to engage the drive sprocket 56 and urge the drive sprocket 56 to rotate in response to rotation of the worm gear 100. It is an advantage of such a worm drive that rotation is unidirectionally transmitted.

Figure 9:
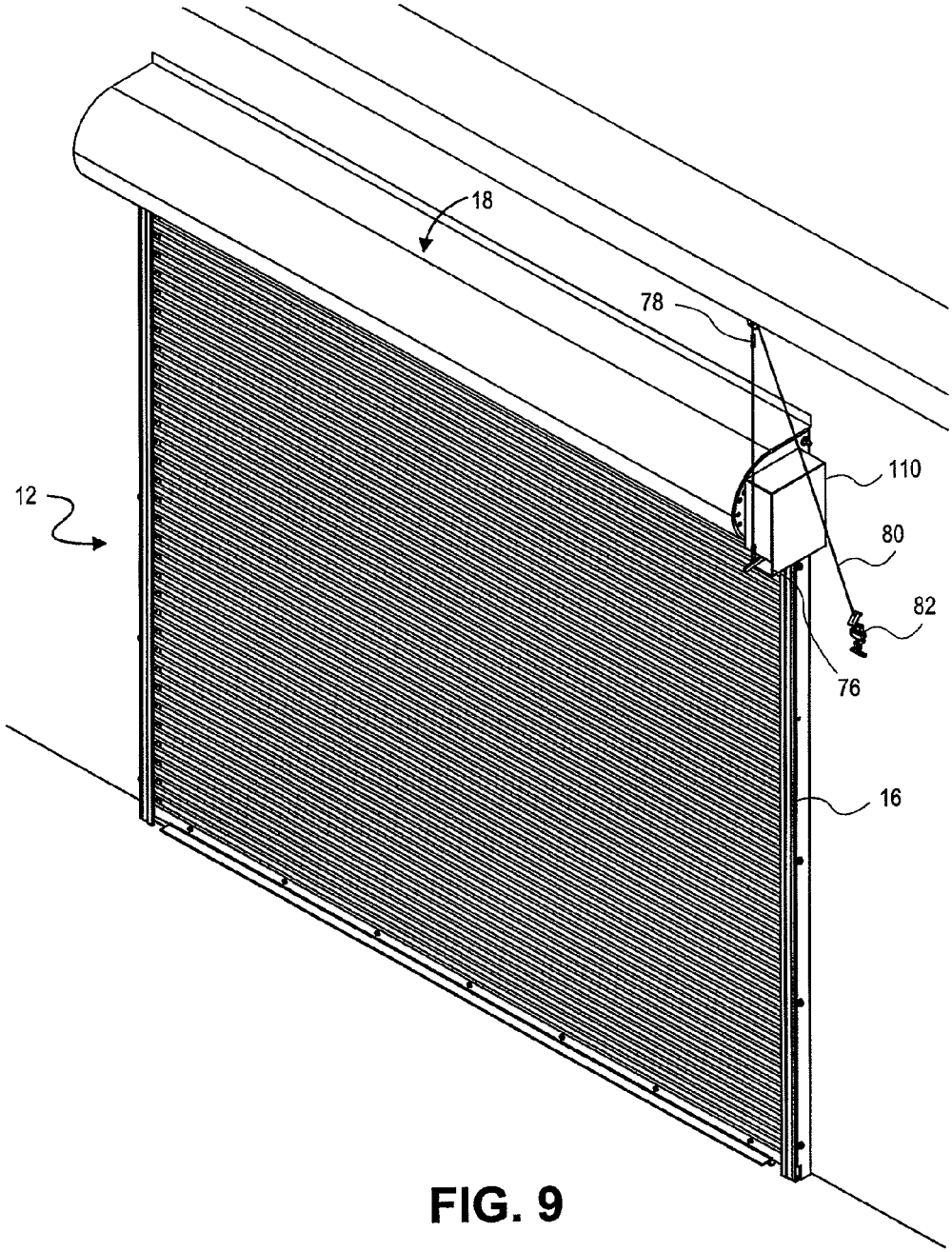
FIG. 9 is a perspective view of a door system according to another embodiment of the invention.

FIG. 9 is a perspective view of a door mechanism 110 according to another embodiment of the invention. In general, the door mechanism 110 is optionally a "push-up push-down" door mechanism that may be raised and/or lowered by hand. As such, a raising and lowering mechanism such as a pull chain, crank arm, and/or motor may be omitted. The door mechanism 110 is similar to the hoist 14 shown in FIG. 1, the various components of which are shown in FIGS. 2-8. Thus, in the interest of brevity, those components described hereinabove may not be described again hereinbelow. As shown in FIG. 9, the door mechanism 110 is configured to operate the door 12 sliding in the track 16. The door mechanism 110 includes the drop arm 76 that is operable to be held in the engaged position via the link 78, line 80, and handle 82.

Figure 10:
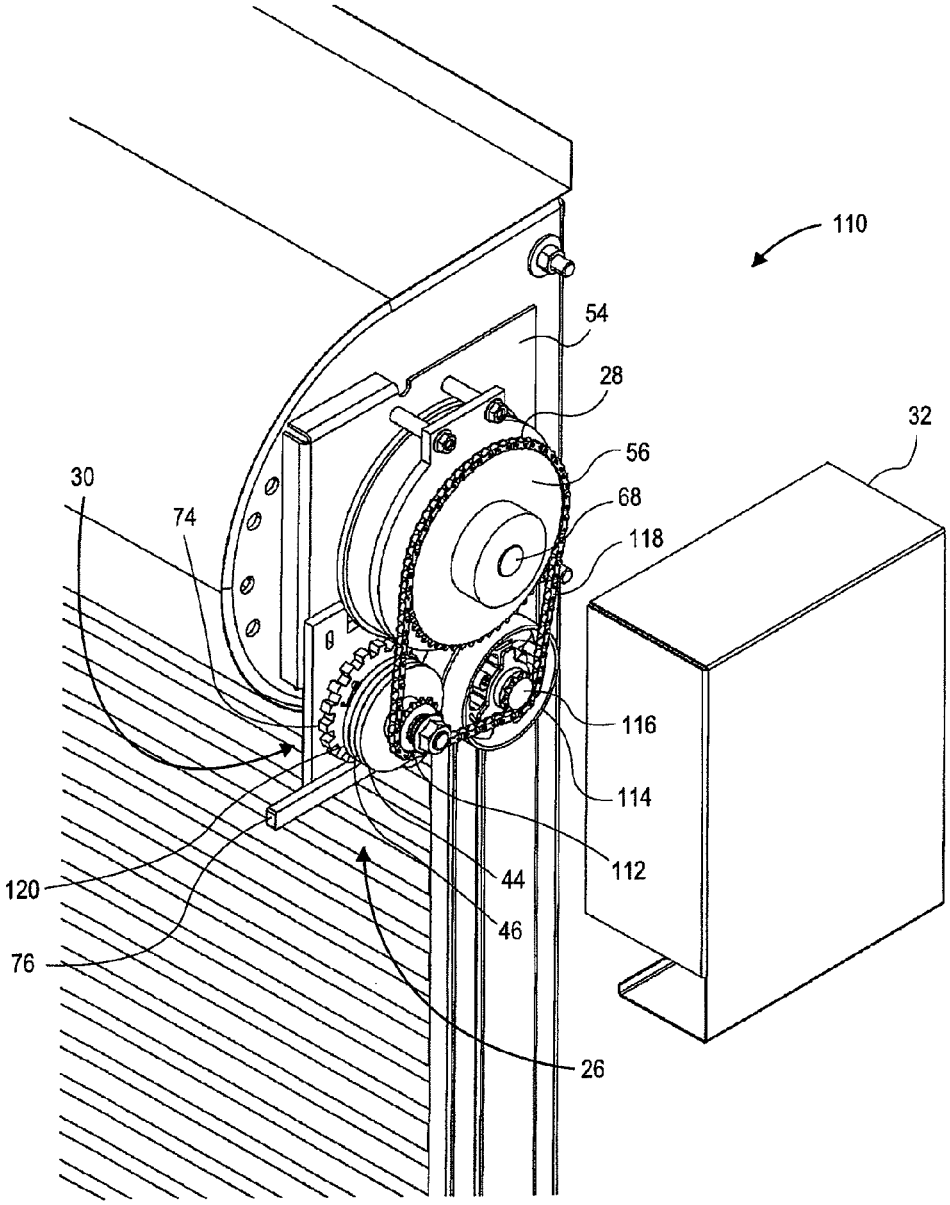
FIG. 10 is a partially exploded view of a door mechanism according to FIG. 9.

FIG. 10 is a partial exploded view of the door mechanism 110 according to FIG. 9. As shown in FIG. 10, with the cover or housing 32 removed, several components, such as the holding brake assembly 26, drive assembly 28, door release 30, mounting plate 54, drive sprocket 56 and door shaft 68 become visible. In addition, the door mechanism 110 includes a holding brake sprocket 112, centrifugal brake 114, brake sprocket 116 and chain 118 to rotationally couple the holding brake sprocket 112 and brake sprocket 116 to the drive sprocket 56.

The holding brake sprocket 112 is fixed to the pressure plate 44 such that the holding brake sprocket 112 and the pressure plate 44 rotate in unison. The brake pad 46 is sandwiched between the pressure plate 44 and a pressure plate 120. The pressure plate 120 is rotationally fixed to the drop wheel 74 via a freewheel 132 as shown in FIG. 11.

The brake sprocket 116 is rotationally coupled to both the drive sprocket 56 and the holding brake sprocket 112 via the chain 118. Rotation of the brake sprocket 116 rotates an internal mechanism of the centrifugal brake 114. The centrifugal brake 114 may include a conventional centrifugal brake. That is, rotation of the brake sprocket 116 causes spring loaded, weighted, brake pads to rotate and generate a centrifugal force that is opposed by the spring. At a predetermined rotational speed, the centrifugal force overcomes the spring force and the weighted brake pads are urged against an inside housing. The resulting friction slows or urges against the rotation of the brake sprocket 116.

Figure 11:
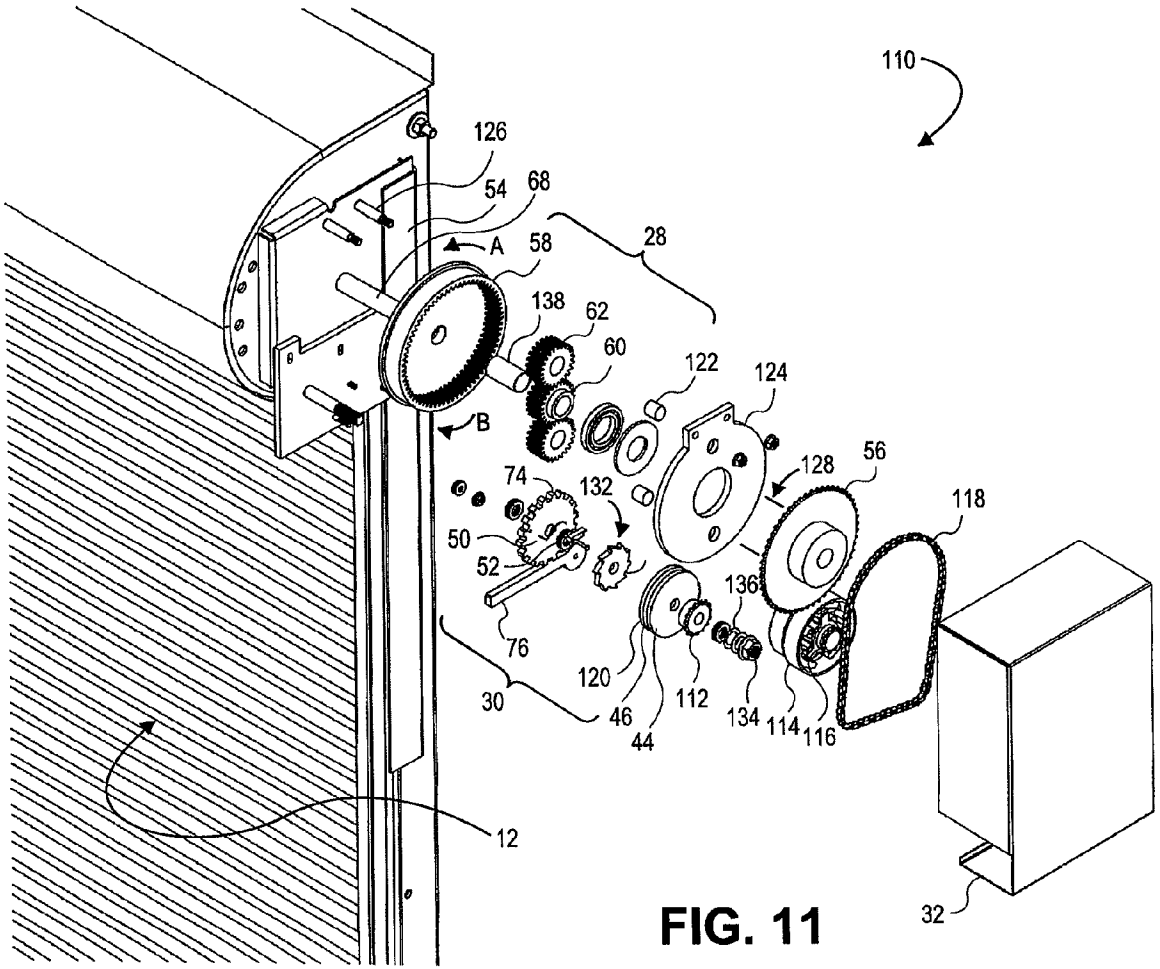

FIG. 11 is an exploded view of the door mechanism 110 according to FIG. 9. As shown in FIG. 11, the drive assembly 28 includes the ring gear 58, sun gear 60, and set of planetary gears 62. The ring gear 58 is fixed to the door shaft 68. The set of planetary gears 62 are mounted on a respective set of stub shafts 122. The set of stub shafts 122 are fixed to a stub shaft plate 124. For example, the set of stub shafts 122 may be press fit or otherwise secured to the stub shaft plate 124. The stub shaft plate 124 may be secured to the mounting plate 54 in any suitable manner. In a particular example, the stub shaft plate 124 may be bolted to the mounting plate 54 via one or more threaded standoffs 126. The sun gear 60 is fixed to the drive sprocket 56 via a set of pins 128. Optionally, the door mechanism 110 may include a sleeve or bushing 138 to reduce friction between the door shaft 68 and the sun gear 60/drive sprocket 56.

In response to the door 12 being raised, the door shaft 68 is rotated in direction "A" which, as shown in FIG. 11 is counterclockwise. Rotation of the door shaft 68 in direction A urges the ring gear 58 to rotate in direction A which also urges the planetary gears 62 to rotate in direction A. Rotation of the planetary gears 62 in direction A urges the sun gear 60 and drive sprocket 56 in direction "B" which is clockwise in the particular example shown in FIG. 11. Of note, in other examples such as in response to the door mechanism 110 being mounted to an opposite end of the door shaft 68, direction A may be clockwise and direction B may be counterclockwise. To continue, rotation of the drive sprocket 56 in direction B urges the chain 118, holding brake sprocket 112 and the brake sprocket 116 to rotate in direction B.

In an embodiment, the holding brake assembly 26 is decoupled from rotation of the drive sprocket 56 in direction B. For example, in response to the holding brake sprocket 112 rotating in direction B and by virtue of a freewheel 132, the holding brake assembly 26 is allowed to freely rotate on the shaft 130 in direction B. In the particular example shown in FIG. 11, the freewheel 132 includes the ratcheted wheel 48, spring 50 and pawl 52. In a particular embodiment, the ratcheted wheel 48 is fixed to the pressure plate 120.

In an embodiment, the raising of the door 12 urges the brake sprocket 116 to rotate in direction B. However, in this or other embodiments, rotation of the brake sprocket 116 may be decoupled from rotation of the various other components of the door mechanism in response to the door 12 being raised. For example, the freewheel 132 may be utilized to decouple rotation of the brake sprocket 116 from the drive sprocket 56.

In response to the door 12 being lowered, the door shaft is urged to rotate in direction B and, via transmission through the drive assembly 28, the drive sprocket 56 is urged to rotate in direction A. This rotation of the drive sprocket 56 in direction A urges the chain 118 in direction A and the holding brake sprocket 112 and brake sprocket 116 are urged to rotate in direction A via the chain 118. In response to the drop arm 76 being in the engaged position, the drop wheel 74 is held fixed and prevented from rotating upon a shaft 130. The freewheel 132 is configured to prevent rotation in direction A which, in turn, prevents the pressure plate 120 from rotating. As such, rotation of the holding brake sprocket 112 and pressure plate 44 is prevented until the torque exerted upon the holding brake sprocket 112 overcomes the frictional resistance provide by the brake pad 46 sandwiched between the pressure plate 44 and pressure plate 120. To adjust the frictional resistance, a jam nut 134 may be tightened or loosened upon the shaft 130. In addition, one or more springs or Belleville washers 136 may be included to facilitate providing a predetermined "pre-loaded" compressive force upon the pressure plate 44.

Figure 12:
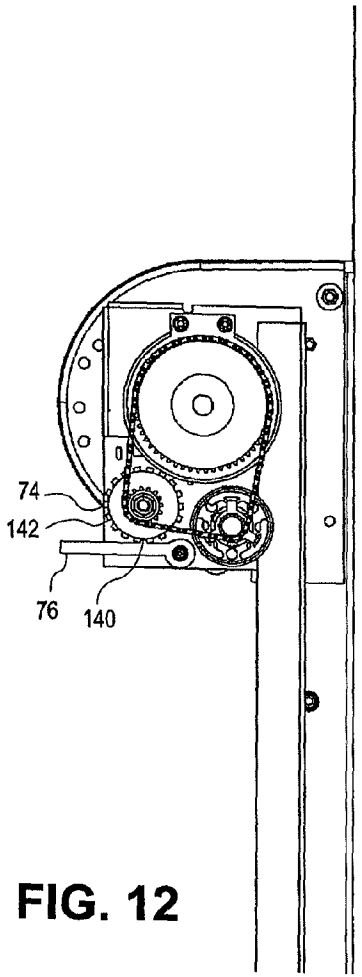
FIG. 12 is a side view of the door mechanism in an engaged position according to FIG. 9.

FIG. 12 is side view of a door mechanism 110 with the drop arm 76 in the engaged position according to an embodiment of FIG. 9. As shown in FIG. 12 (housing 32 removed for clarity), the drop arm 76 includes a tooth 140 to engage a tooth 142 of the drop wheel 74. In response to the drop arm 76 being in the engaged position, and given that the holding brake assembly 26 is adjusted to provide sufficient resistance to offset the closing bias of the door 12, the door 12 (shown in FIG. 9) will remain at a raised position.

Figure 13:
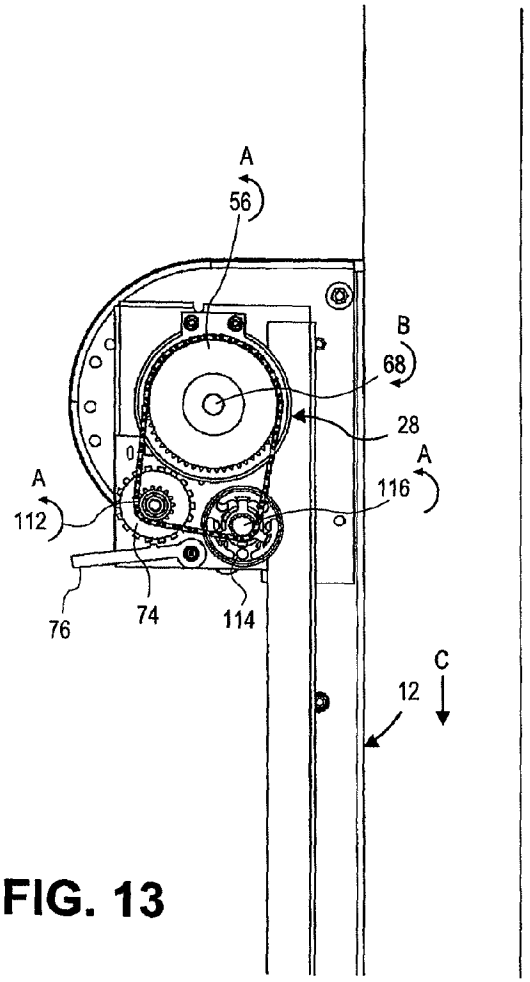
FIG. 13 is a side view of the door mechanism in a disengaged position according to FIG. 9.

FIG. 13 is a side view of a door mechanism 110 with the drop arm 76 in the disengaged position according to an embodiment of FIG. 9. As shown in FIG. 13, in response to the drop arm 76 being in the disengaged position, the drop wheel 74 is allowed to rotate. Given the closing bias of the door 12 in direction C (downward, for example), drop wheel 74, holding brake sprocket 112, brake sprocket 116 and drive sprocket 56 are urged to rotate in direction A, the door shaft 68 is urged to rotate in direction B and the door 12 is allowed to descend in direction C. To facilitate a controlled descent of the door 12, the centrifugal brake 114 is configured to resist rotation of the brake sprocket 116 in response to the brake sprocket 116 exceeding a predetermined maximum speed of rotation. In a particular example, the predetermined maximum speed of rotation is 830 revolutions per minute (RPM). To achieve this speed, the drive assembly 28 is configured to increase the rotational speed of the door shaft 68. In a particular example, the gear ratio between the door shaft 68 and the drive sprocket 56 is about 4:1 and the gear ratio between the drive sprocket 56 and the brake sprocket 116 is about 54:10 for an overall gear ratio of about 216:10.

Figure 14:
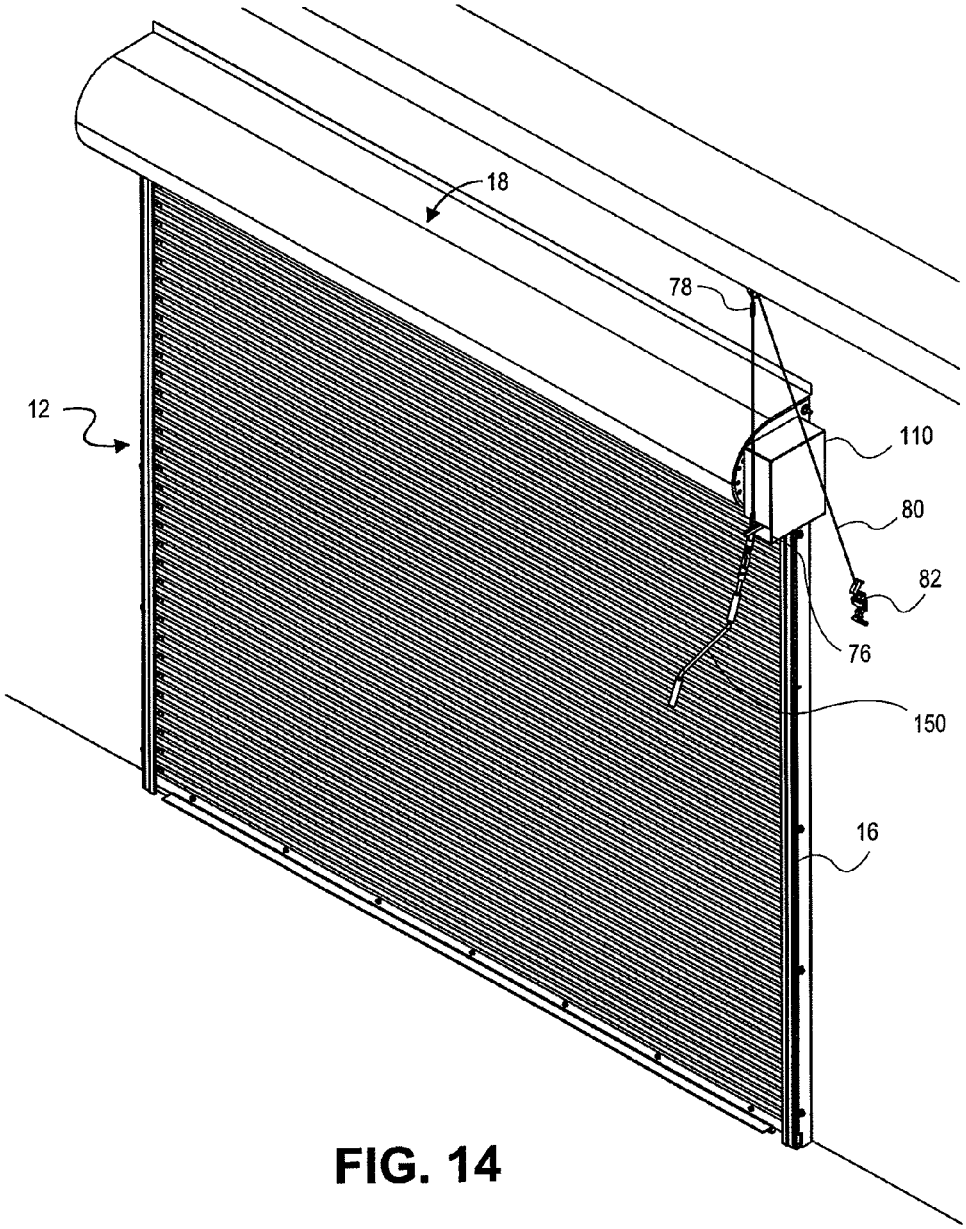
FIG. 14 is a perspective view of a door mechanism according to yet another embodiment of the invention.

FIG. 14 is a perspective view of the door mechanism 110 according to another embodiment of the invention. In general, the door mechanism 110 is optionally operated via a crank arm 150 that may be cranked or rotated by an operator to raise and/or lower the door 12. In addition to operating doors such as the door 12, the door mechanism 110 may be particularly suitable for operating awnings and the like. The door mechanism 110 is similar to the door mechanism 110 shown in FIGS. 9-13. Thus, in the interest of brevity, those components described hereinabove may not be described again hereinbelow. As shown in FIG. 14, the door mechanism 110 is configured to operate the door 12 sliding in the track 16 via the crank arm 150. The door mechanism 110 includes the drop arm 76 that is operable to be held in the engaged position via the link 78, line 80, and handle 82.

Figure 15:
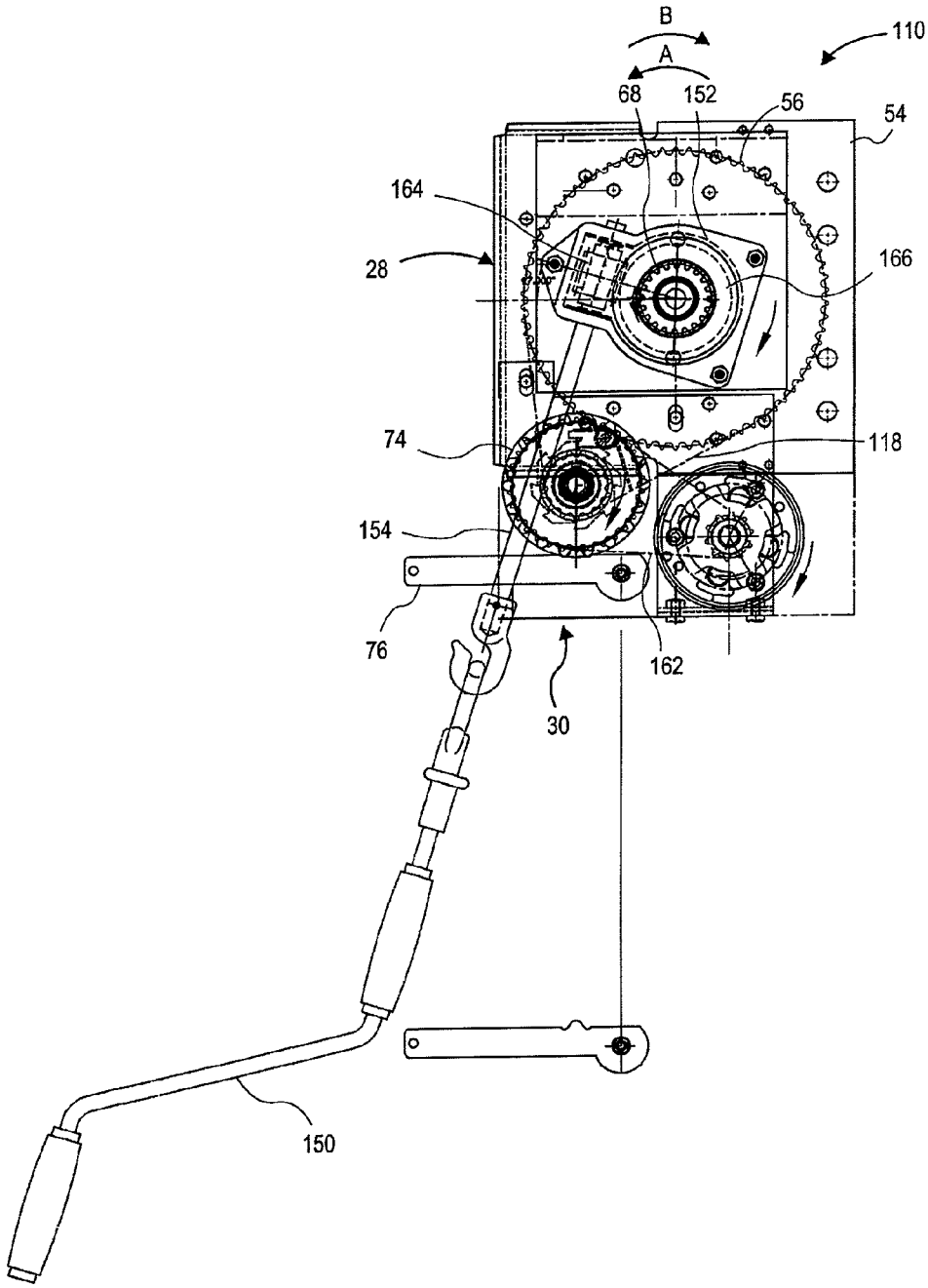
FIG. 15 is a front hidden line view of a door mechanism according to FIG. 14.
Figure 16:
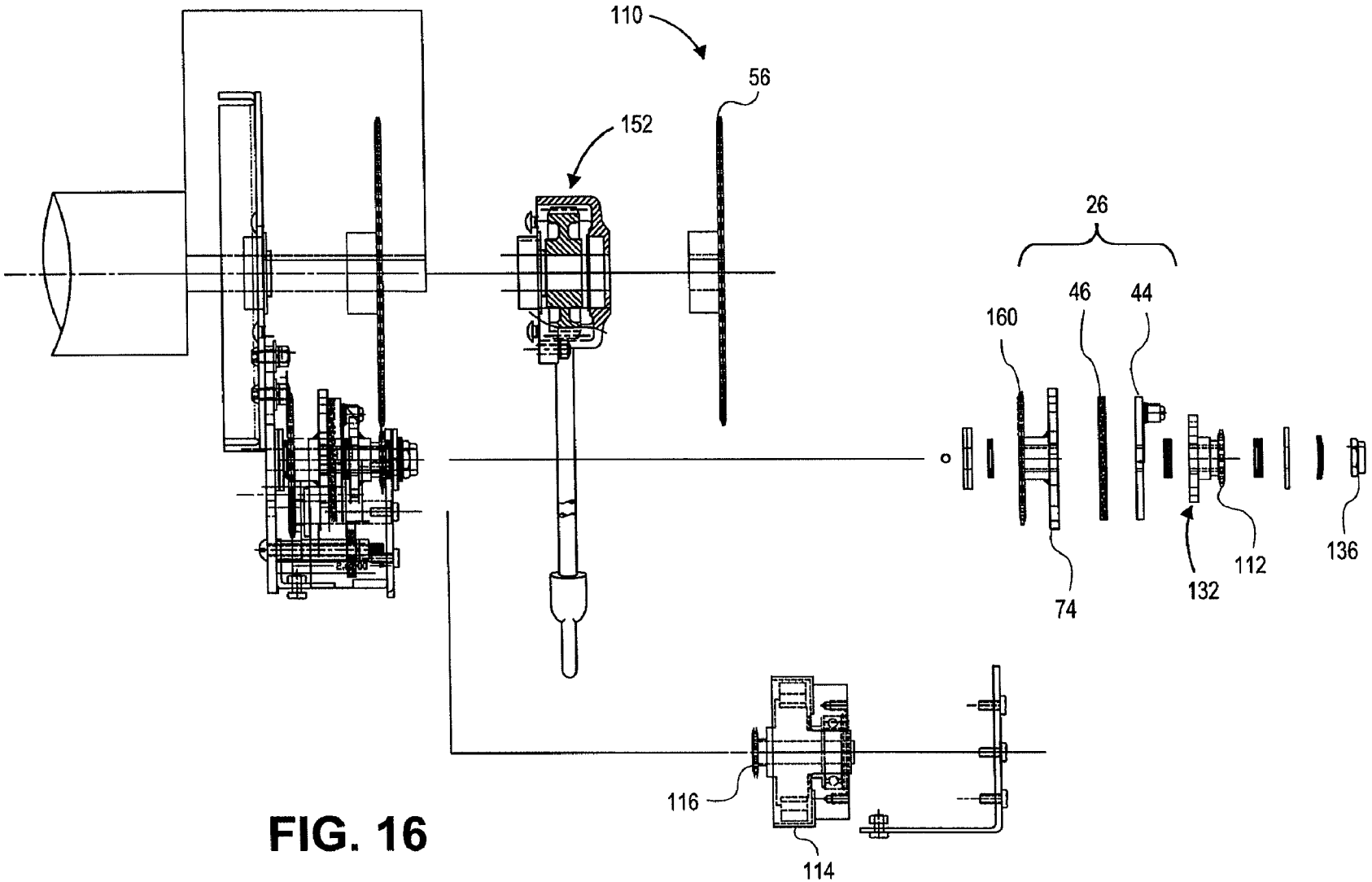
FIG. 16 is a side hidden line view of the door mechanism with added exploded component assemblies according to FIG. 14.

FIG. 15 is a front, hidden line view and FIG. 16 is a side, hidden line view of the door mechanism 110 according to FIG. 14. As shown in FIGS. 15 and 16, the door mechanism 110 includes the holding brake assembly 26, drive assembly 28, door release 30, mounting plate 54, drive sprocket 56 and door shaft 68. Similar to the door mechanism shown in FIG. 10, the door mechanism 110 includes the holding brake sprocket 112, centrifugal brake 114, brake sprocket 116 and chain 118 to rotationally couple the holding brake sprocket 112 to the drive sprocket 56. In addition, the drive assembly 28 includes worm assembly 152. Optionally, the worm assembly 152 includes a worm shaft 154 to detachably secure the crank arm 150 to the worm assembly 152. In other examples, the worm shaft 154/crank arm 150 may be a single unit, multiple segments, replaced with the motor 22, and/or the like.

The holding brake sprocket 112 is fixed to the freewheel 132 such that the holding brake sprocket 112 and the freewheel 132 rotate in unison. The brake pad 46 is sandwiched between the pressure plate 44 and the drop wheel 74. The drop wheel 74 is rotationally fixed to a brake drive sprocket 160. The brake drive sprocket 160 is mated or coupled to the centrifugal brake 114 via a chain 162, for example. It is an advantage of this embodiment that the centrifugal brake 114 is not driven so long as the drop arm 76 is in the engaged position. That is, the holding brake sprocket 112 is rotationally coupled to the drive sprocket 56 via the chain 118 and the holding brake sprocket 112 is rotationally coupled to the brake drive sprocket 160 via the freewheel 132 and holding brake assembly 26. However, as long as the drop wheel 74 is fixed by the drop arm 76, rotation of the holding brake sprocket 112 does not result in rotation of the brake drive sprocket 160. In particular examples, in response to the door 12 being raised, the freewheel 132 is configured to allow the holding brake sprocket 112 to rotate freely in direction A. In response to the door 12 being lowered, rotation of the holding brake sprocket 112 in direction B is translated through the freewheel 132 and to the holding brake assembly 26. If the torque applied to the holding brake sprocket 112 exceeds a predetermined maximum amount of torque, resistance of the holding brake assembly 26 is overcome such that the brake pressure plate 44 is allowed to rotate relative to the drop wheel 74 until the torque applied to the holding brake sprocket 112 falls below the predetermined amount of torque.

In response to the drop arm 76 being in the disengaged position, rotation of the holding brake sprocket 112 in direction B is translated through the holding brake assembly 26 to the brake drive sprocket 160 and, via the chain 162, to the brake sprocket 116. Rotation of the brake sprocket 116 rotates an internal mechanism of the centrifugal brake 114. The centrifugal brake 114 may include a conventional centrifugal brake. That is, rotation of the brake sprocket 116 causes spring loaded, weighted, brake pads to rotate and generate a centrifugal force that is opposed by the spring. At a predetermined rotational speed, the centrifugal force overcomes the spring force and the weighted brake pads are urged against an inside housing. The resulting friction slows or urges against the rotation of the brake sprocket 116.

To facilitate a controlled descent of the door 12, the centrifugal brake 114 is configured to resist rotation of the brake sprocket 116 in response to the brake sprocket 116 exceeding a predetermined maximum speed of rotation. In a particular example, the predetermined maximum speed of rotation is 830 revolutions per minute (RPM). To achieve this speed, the drive assembly 28 is configured to increase the rotational speed of the door shaft 68. In a particular example, the gear ratio between the drive sprocket 56 and the holding brake sprocket 112 is about 4:1 and the gear ratio between the brake drive sprocket 160 and the brake sprocket 116 is about 3:1 for an overall gear ratio of about 12:1.

The worm assembly 152 includes any suitable gear system operable to generate sufficient mechanical advantage. In the case of a human operated door mechanism 110, an about 20:1 to about 30:1 gear ratio may be suitable. Conventional worm gear systems are particularly suitable for generating such ratios. Generally, worm gear systems are unidirectional. That is, turning the worm urges the worm gear to rotate, while urging the worm gear to rotate does not typically cause a conventional, single start, worm to rotate. However, by altering the angle at which the teeth mesh at, a worm gear system or the like may be driven in either direction. For example, a two or three start worm may be turned by rotation of the worm gear. Similarly, helical gear assemblies, spiral bevel gear assemblies, hypoid gear assemblies, and/or the like may be driven in either direction. In the particular example shown, the worm assembly 152 includes a worm 164 and worm gear 166. The worm 163 is fixed to the worm shaft 154. The worm gear 166 is fixed to the door shaft 68. In response to the drop arm 76 being in the disengaged position, the closing bias of the door 12 is configured to drive the drive assembly 28, including the worm assembly 152, in reverse.

Figure 17:
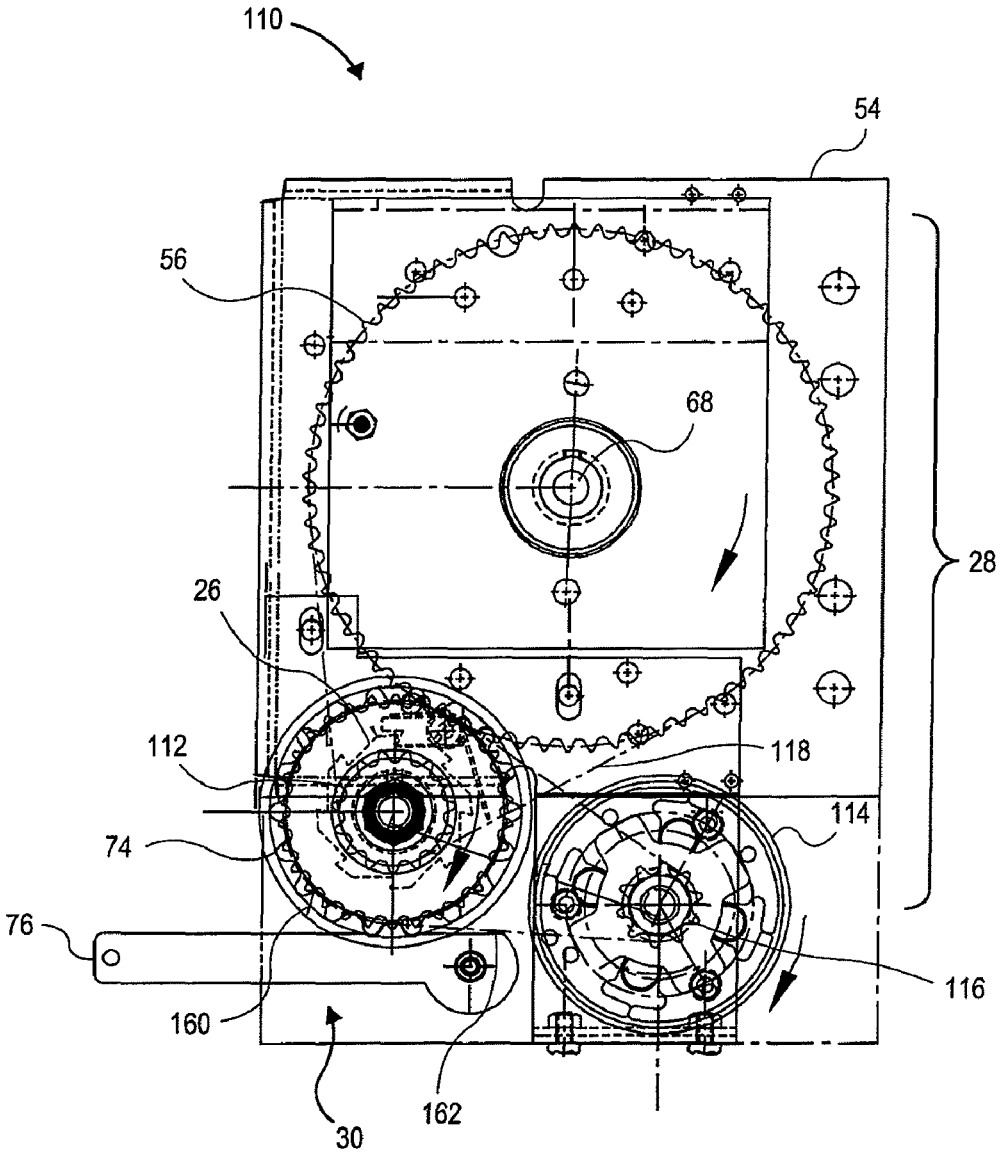
FIG. 17 is a front hidden line view of a door mechanism according to yet another embodiment of the invention.

FIG. 17 is a front hidden line view of the door mechanism 110 according to yet another embodiment of the invention. In general, the door mechanism 110 is optionally a "push-up push-down" door mechanism that may be raised and/or lowered by hand. As such, a raising and lowering mechanism such as a pull chain, crank arm, and/or motor may be omitted. The door mechanism 110 is similar to the door mechanism 110 shown in FIGS. 9-13 and also similar to the door mechanism shown in FIGS. 14-16. Thus, in the interest of brevity, those components described hereinabove may not be described again hereinbelow. As shown in FIG. 17, the door mechanism 110 includes the holding brake assembly 26, drive assembly 28, door release 30, mounting plate 54, drive sprocket 56 and door shaft 68. Particularly shown in FIG. 17 the door mechanism includes the brake drive sprocket 160 coupled to the holding brake sprocket 112 via the chain 162.

Figure 18:
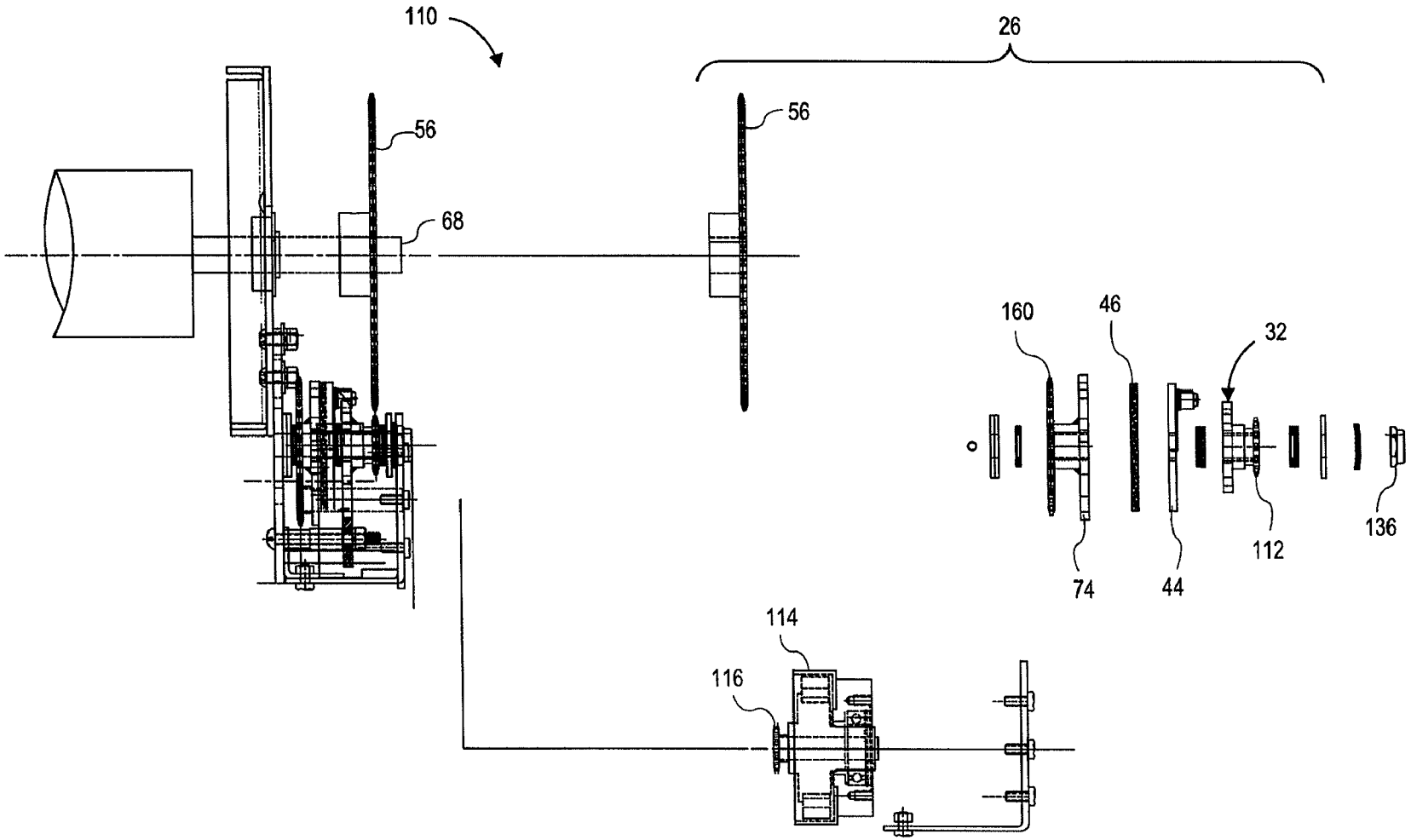
FIG. 18 is a side hidden line view of the door mechanism with added exploded component assemblies according to FIG. 17.

FIG. 18 is a side hidden line view of the door mechanism 110 with added exploded component assemblies according to FIG. 17. As shown in FIGS. 17 and 18, the holding brake sprocket 112 is fixed to the freewheel 132 such that the holding brake sprocket 112 and the freewheel 132 rotate in unison. The brake pad 46 is sandwiched between the pressure plate 44 and the drop wheel 74. The drop wheel 74 is rotationally fixed to a brake drive sprocket 160. The brake drive sprocket 160 is mated or coupled to the centrifugal brake 114 via a chain 162, for example. It is an advantage of this embodiment that the centrifugal brake 114 is not driven so long as the drop arm 76 is in the engaged position. That is, the holding brake sprocket 112 is rotationally coupled to the drive sprocket 56 via the chain 118 and the holding brake sprocket 112 is rotationally coupled to the brake drive sprocket 160 via the freewheel 132 and holding brake assembly 26. However, as long as the drop wheel 74 is fixed by the drop arm 76, rotation of the holding brake sprocket 112 does not result in rotation of the brake drive sprocket 160. In particular examples, in response to the door 12 being raised, the freewheel 132 is configured to allow the holding brake sprocket 112 to rotate freely in direction A. In response to the door 12 being lowered, rotation of the holding brake sprocket 112 in direction B is translated through the freewheel 132 and to the holding brake assembly 26. If the torque applied to the holding brake sprocket 112 exceeds a predetermined maximum amount of torque, resistance of the holding brake assembly 26 is overcome such that the brake pressure plate 44 is allowed to rotate relative to the drop wheel 74 until the torque applied to the holding brake sprocket 112 falls below the predetermined amount of torque.

In response to the drop arm 76 being in the disengaged position, rotation of the holding brake sprocket 112 in direction B is translated through the holding brake assembly 26 to the brake drive sprocket 160 and, via the chain 162, to the brake sprocket 116. Rotation of the brake sprocket 116 rotates an internal mechanism of the centrifugal brake 114. The centrifugal brake 114 may include a conventional centrifugal brake. That is, rotation of the brake sprocket 116 causes spring loaded, weighted, brake pads to rotate and generate a centrifugal force that is opposed by the spring. At a predetermined rotational speed, the centrifugal force overcomes the spring force and the weighted brake pads are urged against an inside housing. The resulting friction slows or urges against the rotation of the brake sprocket 116.

To facilitate a controlled descent of the door 12, the centrifugal brake 114 is configured to resist rotation of the brake sprocket 116 in response to the brake sprocket 116 exceeding a predetermined maximum speed of rotation. In a particular example, the predetermined maximum speed of rotation is 830 RPM. To achieve this speed, the drive assembly 28 is configured to increase the rotational speed of the door shaft 68. In a particular example, the gear ratio between the drive sprocket 56 and the holding brake sprocket 112 is about 70:15 and the gear ratio between the brake drive sprocket 160 and the brake sprocket 116 is about 3:1 for an overall gear ratio of about 14:1.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A door mechanism comprising:

a bracket;

a door shaft to operate a door, the door shaft being rotationally mounted to the bracket, the door shaft rotating in a first direction in response to the door being raised, the door shaft rotating in a second direction in response to door being lowered, the door being biased to close;

a gear assembly comprising:

a ring gear fixed to the door shaft;

a set of planetary gears mated to the ring gear, a set of respective axes of the set of planetary gears being fixed relative to the bracket;

a sun gear mated to the set of planetary gears; and a drive sprocket fixed to the sun gear;

a holding brake to counter the closing bias of the door, the holding brake comprising:

a holding brake sprocket rotationally coupled to the drive sprocket;

a freewheel coupled to the holding brake sprocket to facilitate free rotation of the door shaft in the first direction; and a first brake coupled to the holding brake sprocket via the freewheel to provide resistance to rotation of the door shaft in the second direction;

a door release having an engaged position and a disengaged position, in response to the door release being in the engaged position, rotation of the door shaft in the second direction is impeded by the first brake, in response to the door release being in the disengaged position, rotation of the door shaft in the second direction is unimpeded by the first brake;

a link to secure the door release in the engaged position, the link being configured to melt in response to an ambient temperature exceeding a predetermined temperature; and a second brake having a brake sprocket rotationally coupled to the drive sprocket, the second brake being configured to provide resistance to the brake sprocket in response to rotation of the brake sprocket exceeding a predetermined braking speed.

2. The door mechanism according to claim 1, wherein the freewheel includes a ratchet and pawl.

3. The door mechanism according to claim 1, wherein the first brake is a frictional brake comprising a friction plate sandwiched between a first plate and a second plate, the first plate is fixed to rotate with the holding brake sprocket, the second plate is fixed to rotate with the drop wheel.

4. The door mechanism according to claim 3, wherein the first brake includes a spring to urge the first plate towards the second plate.

5. The door mechanism according to claim 1, wherein the second brake is a centrifugal brake.

6. The door mechanism according to claim 1, wherein the second brake is a viscous brake.

* * * * *